US006830678B2

(12) United States Patent
Didillon et al.

(10) Patent No.: US 6,830,678 B2
(45) Date of Patent: Dec. 14, 2004

(54) PROCESS OF DESULPHURIZING GASOLINE COMPRISING DESULPHURIZATION OF THE HEAVY AND INTERMEDIATE FRACTIONS RESULTING FROM FRACTIONATION INTO AT LEAST THREE CUTS

(75) Inventors: Blaise Didillon, Francheville (FR); Denis Uzio, Marly le Roi (FR); Quentin Debuisschert, Rueil Malmaison (FR); Jean-Luc Nocca, Houston, TX (US)

(73) Assignee: Institut Francais DuPetrole, Rueil-Malmaison (FR)

( * ) Notice: Subject to any disclaimer, the term of this patent is extended or adjusted under 35 U.S.C. 154(b) by 192 days.

(21) Appl. No.: 09/819,949

(22) Filed: Mar. 29, 2001

(65) Prior Publication Data

US 2001/0050244 A1 Dec. 13, 2001

(30) Foreign Application Priority Data

Mar. 29, 2000 (FR) ..... 00 04084

(51) Int. Cl.[7] ..... C10G 65/06; C07C 5/03

(52) U.S. Cl. ..... 208/211; 208/97; 208/89; 208/57; 208/210; 585/259; 585/260; 585/261; 585/262; 585/264

(58) Field of Search ..... 208/211, 97, 89, 208/57, 210; 585/259, 260, 261, 262, 264

(56) References Cited

U.S. PATENT DOCUMENTS 3,494,859 A * 2/1970 Parker ..... 208/210
3,691,066 A 9/1972 Carruthers et al. ..... 208/255 R
3,732,155 A * 5/1973 Cecil et al. ..... 208/210
4,131,537 A 12/1978 Winter et al. ..... 208/216
5,290,427 A 3/1994 Fletcher et al. ..... 208/89
5,597,476 A * 1/1997 Hearn et al. ..... 208/208 R
5,599,441 A * 2/1997 Collins et al. ..... 208/134
6,231,752 B1 * 5/2001 Putman ..... 208/213
6,444,118 B1 * 9/2002 Podrebarac et al. ..... 208/210

FOREIGN PATENT DOCUMENTS

EP 0 725 126 A1 8/1996
EP 0 832 958 A1 4/1998
FR 2 720 754 12/1995
WO WO 97/03150 1/1997

* cited by examiner

*Primary Examiner*—Walter D. Griffin
(74) *Attorney, Agent, or Firm*—Millen, White, Zelano, Branigan, P.C.

(57) ABSTRACT

The invention relates to a process of producing gasoline with a low sulphur content from a feedstock containing sulphur. This process comprises at least one step a1 of selectively hydrogenating the diolefins and acetylenic compounds, at least one separation of the gasoline (step b) obtained at step a1 into at least three fractions, at least one step c1 of treating the heavy gasoline separated at step b on a catalyst enabling the unsaturated sulphur compounds to be at least partially decomposed or hydrogenated and at least one step d to remove the sulphur and nitrogen from at least one intermediate fraction, followed by catalytic reforming.

35 Claims, 1 Drawing Sheet

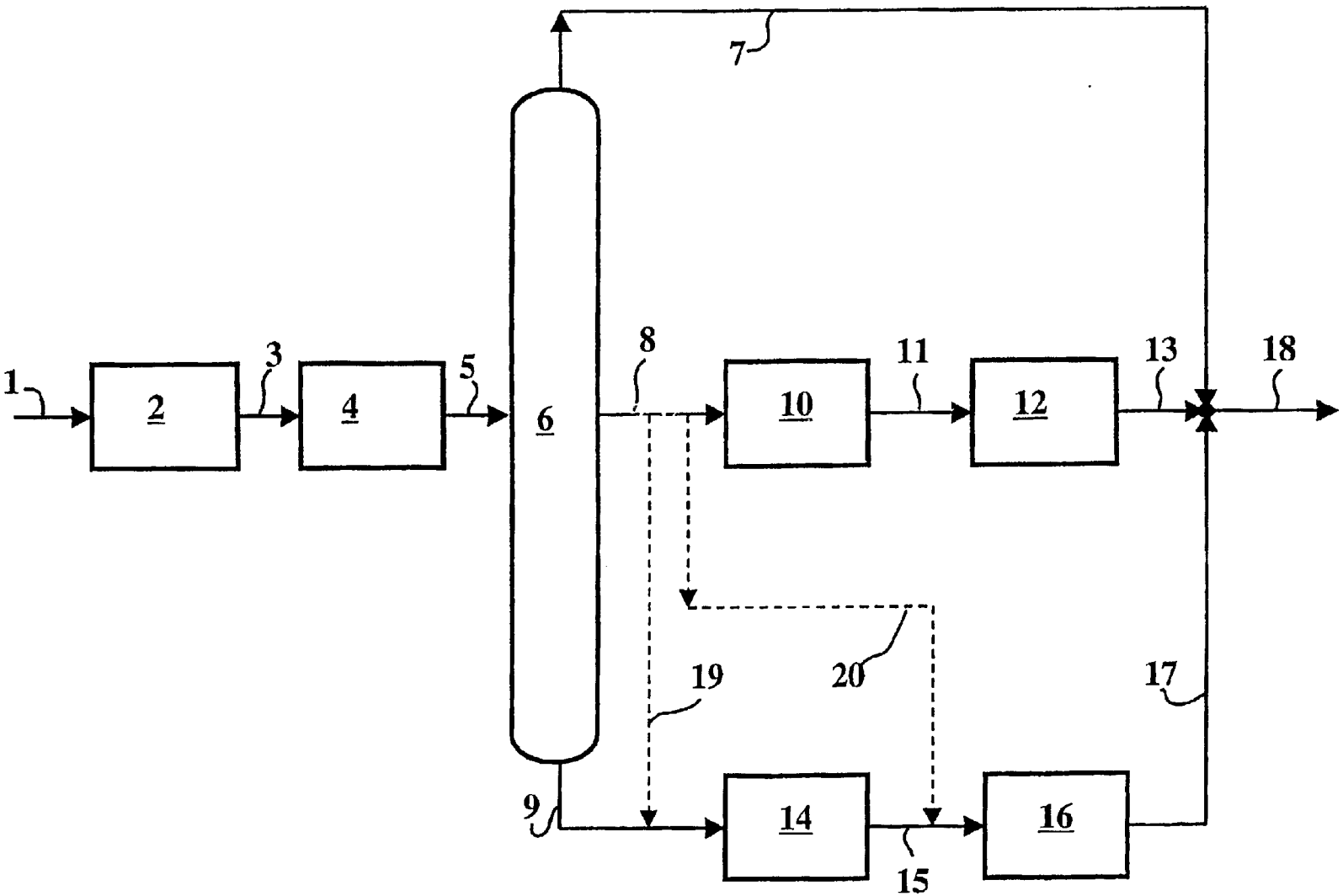
1
2
3
4
5
6
7
8
9
10
11
12
13
14
15
16
17
18
19
20

PROCESS OF DESULPHURIZING GASOLINE COMPRISING DESULPHURIZATION OF THE HEAVY AND INTERMEDIATE FRACTIONS RESULTING FROM FRACTIONATION INTO AT LEAST THREE CUTS

BACKGROUND OF THE INVENTION

If the production of reformulated gasolines is to meet the new environmental standards, it is necessary, in particular, to reduce the concentration of olefins slightly and the concentration of aromatics (especially benzene) and sulphur to a large degree. Gasolines produced by catalytic cracking, which may account for 30 to 50% of the gasoline pool, have high contents of olefins and sulphur. In about 90% of cases, the sulphur present in reformulated gasolines is attributable to gasoline produced by catalytic cracking (FCC—Fluid Catalytic Cracking, or catalytic cracking operated in a fluidized bed). Desulphurization (hydro-desulphirization) of gasolines and of FCC gasolines in particular is therefore becoming manifestly more important as a means of meeting specifications. Apart from gasoline produced by catalytic cracking, other gasolines, such as gasolines obtained directly from the distillation of crude oil, or gasolines produced by conversion (coking, steam cracking or others) may account for a significant contribution to the sulphur in gasoline.

Hydro-cracking (hydro-desulphurization) of the feedstock introduced in catalytic cracking gives rise to gasolines which typically contain 100 ppm of sulphur. However, the units used for hydro-processing feedstocks in catalytic cracking are operated under severe temperature and pressure conditions, implying a high capital outlay. Furthermore, the entire feedstock used in the catalytic cracking process has to be desulphurized, which means having to process very high volumes of feedstock.

When conducted under the conventional conditions with which the skilled person is familiar, hydro-processing (hydro-desulphurization) of gasolines from catalytic cracking enables the sulphur content of the cut to be reduced. However, this process has the major disadvantage of leading to a very high drop in the octane number of the cut due to the fact that a significant proportion of the olefins becomes saturated during hydro-processing.

The idea of separating the light gasoline from the heavy gasoline prior to hydro-processing has already been claimed by patent U.S. Pat. No. 4,397,739. This type of separation enables a light cut, rich in olefins and with a low sulphur content, which will no longer be compatible with future specifications, to be separated from a rich heavy cut with a low olefin content and containing a high proportion of the sulphur from the initial gasoline. This patent claims a process of hydro-desulphurizing gasolines, which consists in fractionating the gasoline into a light fraction and a heavy fraction followed by specific hydro-desulphurization of the heavy gasoline but does not propose any solution for eliminating the sulphur present in the light gasoline.

U.S. Pat. No. 4,131,537, on the other hand, teaches a process based on fractionating the gasoline into several cuts, preferably three, depending on their boiling point, and desulphurizing them under conditions which may be different and in the presence of a catalyst containing at least one metal from group VIB and/or group VII. According to this patent, the main benefit is to be obtained by fractionating the gasoline into three cuts and treating the cut having intermediate boiling points under mild conditions.

Patent application EP-A-0 725 126 describes a process of desulphurizing a gasoline derived from cracking in which the gasoline is separated into a plurality of fractions comprising at least a first fraction rich in compounds that can be readily desulphurized and a second fraction rich in compounds that are difficult to desulphurize. Prior to this separation, it is necessary to determine the distribution of products containing sulphur by analyses. These analyses are necessary in order to select the equipment and the separation conditions.

This application states, for example, that the olefin content and octane number of a light fraction of gasoline derived from cracking will drop significantly if it is desulphurized without being fractionated. Fractionating said light fraction into 7 to 20 fractions, on the other hand, followed by analysis of the sulphur and olefin contents of these fractions enables the fractions with the highest contents of sulphur compounds to be determined and these are then desulphurized simultaneously or separately and mixed with the other desulphurized fractions or not. A procedure of this type is complex and has to be reproduced with each change in the composition of the gasoline to be treated.

French patent application No. 98/14480 teaches the idea of fractionating the gasoline into a light fraction and a heavy fraction, followed by a specific hydro-treatment of the light gasoline on a nickel-based catalyst and a hydro-treatment of the heavy gasoline on a catalyst containing at least one metal from group VIII and/or at least one metal from group VIb.

Processes for hydro-treating gasolines have also been proposed, in patent U.S. Pat. No. 5,290,427 for example, which consist in fractionating the gasoline, then delivering the fractions to different levels of a hydro-desulphurization reactor and converting the (desulphurized fractions on a ZSM-5 zeolite in order to compensate for the detected loss of octane by isomerization.

In these processes, the gasolines to be treated generally have an initial point in excess of 70° C. and again, it is necessary to treat the light gasoline (fraction corresponding to the compounds with a boiling point between the C5 (hydrocarbons with 5 carbon atoms) and 70° C. separately by softening.

U.S. Pat. No. 5,318,690 proposes a process which consists in fractionating the gasoline and softening the light gasoline, whilst the heavy gasoline is desulphurized and then converted on ZSM-5 and desulphurized again under soft conditions. This technique is based on separating the crude gasoline to obtain a light cut which contains practically no sulphur compounds other than mercaptans. This enables said cut to be treated by a softening process only, which removes the mercaptans.

As a result, the heavy gasoline contains a relatively high quantity of olefins, which are partially saturated during hydro-processing. In order to compensate for the loss in octane number inherent in hydrogenation of the olefins, the patent proposes cracking on a ZSM-5 zeolite, which produces olefins but to the detriment of yield. Furthermore, these olefins may recombine with the $H_2S$ present in the medium to reform mercaptans. It is therefore necessary to operate a softening process or additional hydro-desulphurization.

SUMMARY OF THE INVENTION

The present invention relates to a process of desulphurizing gasoline, i.e. a process of producing gasolines with a low sulphur content, which enables an entire feedstock containing the sulphur (generally a gasoline cut) to be processed, preferably a gasoline cut produced by catalytic cracking, and allows the sulphur content in said gasoline cut to be reduced to very low levels, without significantly reducing the gasoline yield and whilst minimising the drop in octane number due to hydrogenation of the olefins. The process according to the invention also enables at least some of the potential octane losses caused by hydrogenation of the olefins to be restored by reforming one of the previously desulphurized gasoline fractions.

The process according to the invention is a process of producing gasoline with a low sulphur content from a feedstock containing sulphur. It comprises at least the following steps:

a1) at least one selective hydrogenation of the diolefins and acetylene compounds present in the feedstock, a2) optionally at least one step intended to increase the molecular weight of the light sulphur products present in the feedstock or the effluent from step a1. This step may optionally be performed simultaneously with step al for at least a part of the feedstock, in the same reactor or a different reactor. It may also be operated separately on at least some of the feedstock hydrogenated at step a1.

b) at least one separation (also referred to as fractionation hereafter) of the gasoline obtained at step a1 or a2 into at least three fractions (or cuts), a light fraction containing the lightest olefins from the initial gasoline (light gasoline or light fraction), a heavy fraction in which the greater part of the sulphur compounds initially present in the original gasoline is concentrated (heavy gasoline or fraction) and at least one intermediate fraction with a relatively low olefin content and aromatic content and hence a low octane number compared with the light and heavy fractions of this gasoline.

c1) at least one treatment of the heavy gasoline separated at step b on a catalyst, enabling the unsaturated sulphur compounds to be at least partially decomposed or hydrogenated, in particular the cyclic sulphur or even aromatic compounds such as the thiophenic compounds for example, by operating under conditions conducive to limiting hydrogenation of the olefins on this catalyst. Prior to or after this step c1, the heavy fraction may optionally be mixed with at least a part of an intermediate fraction from the separation step b and preferably not desulphurized.

c2) step c1 is optionally followed by a step c2 of processing the effluent from step c1 on a catalyst, which enables the sulphur compounds and more preferably the linear and/or cyclic saturated sulphur compounds, to be decomposed, accompanied by limited hydrogenation of the olefins.

d) at least one step intended to reduce significantly the sulphur and nitrogen content of at least one of the intermediate fractions. This step of removing the sulphur and nitrogen is preferably accompanied by a practically total hydrogenation of the olefins contained in this fraction. The resultant fraction is then preferably treated by catalytic reforming in order to increase the octane number of said intermediate cut(s).

e) and optionally a step e during which at least two fractions are mixed, one of which, at least, having been subjected to a desulphurization treatment at step c1 and optionally c2 and/or at step d.

The catalytic treatments at steps c1 and/or c2 may be operated either in a single reactor containing the two catalysts or in at least two different reactors. If the treatment is operated using two reactors, they are preferably disposed in series, the second reactor preferably being used to treat all the effluent issuing from the first reactor, preferably without separating the liquid and gas between the first and second reactor. It is also possible to use several reactors, disposed in parallel or in series, for one and/or the other of steps c1 or c2.

Furthermore, a step e is preferably operated after step d, this step consisting in mixing the gasolines separated at step b, whether they have been subjected to desulphurization treatments or not.

The feedstock used in the process according to the invention is generally a gasoline cut containing sulphur, such as a cut from a coking, visbreaking, steam cracking or catalytic cracking (FCC) unit, for example. Said feedstock preferably consists of a gasoline cut from a catalytic cracking unit, in which the range of boiling points typically ranges from approximately the boiling points of hydrocarbons with 5 carbon atoms ($C_5$) up to approximately 250° C. This gasoline may optionally contain a significant fraction of gasoline from origins other than the gasolines derived directly from atmospheric distillation of crude oil (straight run gasoline) or a conversion process (coked or steam cracked gasoline, for example). The final point of the gasoline cut will depend on the refinery from which it came as well as market constraints, but is generally within the limits given above.

DETAILED DESCRIPTION OF THE INVENTION

The present invention describes a process of producing a gasoline containing sulphur compounds, preferably from a catalytic cracking unit, in which the gasoline is firstly subjected to a selective hydrogenation treatment of the olefins and acetylenic compounds, optionally followed by a step intended to make heavier the lightest sulphur compounds which may be present in the gasoline and would otherwise be present in the light gasoline after fractionation if this step were omitted, at least one process of separating the gasoline into at least three fractions, treatment of at least one of the intermediate fractions with a view to removing most of the sulphur and nitrogen from this cut before applying a catalytic reforming treatment, treatment of the heavy gasoline, optionally mixed with at least a part of one of the intermediate fractions, using a known catalyst, in order to promote transformation of the unsaturated sulphur compounds present in the gasoline, such as the thiophenic compounds for example, into saturated sulphur compounds such as thiophane or mercaptans, optionally followed by a second catalyst to promote selective transformation of the saturated sulphur compounds, linear or cyclic, already present in the heavy cut or produced during the previous treatment. The heavy and intermediate fractions thus treated and optionally the light gasoline fraction may then be mixed in order to obtain a desulphurized gasoline.

This process chain enables a desulphurized gasoline to be obtained in fine, allowing the content of olefins or octane index to be controlled and does so al high desulphurization rates. This process enables high hydro-desulphurization rates to be obtained under reasonable operating conditions, as will be described below. Furthermore, by optimising the cut points of intermediate fractions and selecting those to be directed to the catalytic reforming step, the benzene content in the final gasoline can be reduced to a minimum (for example to contents of less than 5% by weight in the final mixture of desulphurized gasoline fractions), the olefin content can be controlled and the values of the Research Octane Number and Motor Octane Number can be kept high.

The sulphur species contained in the feedstocks treated by the process of the invention may be mercaptans or heterocyclic compounds such as thiophens or alkyl-thiophens, for example, or heavier compounds such as benzothiophen or dibenzothiophen. If a gasoline containing light sulphur compounds is fractionated into two cuts, a light cut rich in olefins and a heavy cut with a low olefin content, the light sulphur compounds (for example ethyl mercaptan, propyl mercaptan and optionally thiophen) may be partially or even totally present in the light gasoline. This being the case, it is often necessary to apply an additional treatment to this light fraction in order to reduce its sulphur content. Conventionally, this treatment takes the form of an extractive softening process which enables the light sulphur compounds present in the form of mercaptans to be removed from the gasoline. Apart from the fact that this treatment increases the cost of the operation prohibitively, it is only feasible if the sulphur is in the form of mercaptan. Accordingly, the fractionation point of the gasoline must preferably be limited so as not to give rise to the presence of thiophen in the light gasoline. The latter, in effect, forms azeotropes with a certain number of hydrocarbons so that only the $C_5$ olefins and a small proportion of the $C_6$ olefins can be separated from the light gasoline without giving rise to too large a fraction of thiophen in this cut.

In the process according to the invention, in order to recover a larger fraction of the olefins present in the light gasoline whilst limiting the sulphur content of this fraction without additional treatment, it is proposed, as a preference, that the feedstock be treated, after a first selective hydrogenation step, under conditions and on catalysts which enable the light sulphur compounds to be converted into sulphur compounds with a higher boiling point so that they will be contained in the heavier fractions after the separation step. The gasoline is then fractionated into at least three cuts: a light fraction which contains a significant fraction of the olefins initially present in the gasoline to be treated but a low quantity of sulphur compounds, at least one intermediate fraction from which the sulphur and nitrogen have been removed prior to treatment on a reforming catalyst, and a heavy fraction which is desulphurized under defined conditions and using a catalyst or a chain of catalysts enabling high desulphurization rates to be obtained whilst limiting the hydrogenation rate of the olefins and hence the loss of octane.

In order to minimise the benzene content of the final gasoline, one of the preferred approaches to implementing the invention is to treat the feedstock under conditions and using catalysts which enable the light sulphur compounds to be transformed into sulphur compounds with higher boiling points which will then be found in the heavier fractions after the separation step. The gasoline is then separated into 4 cuts:

- a light fraction containing the main fraction of molecules with 5 carbon atoms ($C_5$) and a significant fraction of the molecules with 6 carbon atoms ($C_6$) initially present in the gasoline to be treated. This fraction is characterised by a high concentration of olefins and a very low sulphur content.
- a first intermediate fraction essentially (i.e. more than 60% by weight and preferably more than 80% by weight) consisting of molecules with six carbon atoms ($C_6$) and a part of the molecules having 7 carbon atoms ($C_7$) as well as the greater part of sulphur compounds with a boiling point close to that of the azeotrope which it forms with the hydrocarbons, give or take approximately 20%. This fraction is preferably mixed with the heavy gasoline prior to hydro-desulphurization (steps c1 and c2) or after at least partial decomposition or hydrogenation of the unsaturated sulphur compounds (step c1) but before decomposition of the saturated sulphur compounds (step c2), so that it can be desulphurized under conditions that will enable hydrogenation of the olefins to be limited. By preference, this gasoline is not delivered to the catalytic reforming process because it contains a number of compounds which would cause benzene to form during the reforming treatment. The person skilled in the art is familiar with these compounds as "benzene precursors", which may be methyl cyclopentane, n-hexane or benzene itself, for example. If permitted under local legislation, however, this intermediate cut may optionally be fed to the unit processing the second intermediate cut;
- a second intermediate fraction from which sulphur and nitrogen have been removed on a conventional hydrotreatment catalyst in order to eliminate virtually all the sulphur and nitrogen initially present in this cut (i.e. to reduce their content to less than 5 ppm, preferably less than 1 ppm). This treatment is accompanied by virtually total hydrogenation of the olefins in this cut, enabling the olefin content to be reduced to values preferably below 10% by weight and even more preferably below 5% by weight. This cut is then treated on a catalytic reforming catalyst enabling isomerization and dehydrocyclization of the paraffins and naphthenes with formation of branched paraffins and aromatic compounds.
- the heavy cut, preferably mixed with the first intermediate fraction, is desulphurized under defined conditions and using a chain of catalysts enabling high desulphurization rates to be obtained whilst limiting the rate of hydrogenation of the olefins and hence the loss in octane.

Accordingly, when the light, intermediate and heavy gasoline cuts are mixed after the desulphurization treatments proposed by the invention, the drop in Research or Motor Octane Number, expressed as the difference between the mean value (RON+MON)/2 observed in this mixture and the mean value (RON+MON)/2 of the initial feedstock, is limited to less than 2 points of octane, preferably less than 1.7 points of octane, and even more preferably less than 1.5 points of octane, and yet more preferably less than 1 point o octane. In certain cases, the mean value (RON+MON)/2 of the gasoline desulphurized by the process according to the invention may fall by less than 0.5 point octane relative to the mean value (RON+MON)/2 of the feedstock, or, on the contrary, may even increase by at least 0.5 point.

The sulphur content of gasoline cuts produced by catalytic cracking (FCC) depends on the sulphur content of the feedstock treated by FCC and on the final point of the cut. Generally speaking, the sulphur content of a gasoline cut as a whole, in particular those resulting from FCC, are greater than 100 ppm by weight and more often than not greater than 500 ppm by weight. In gasoline cuts whose final points are higher than 200° C., the sulphur content is often greater than 1000 ppm by-weight and in certain cases may even be as much as 4000 to 5000 ppm by weight.

The process according to the invention can be applied in particular if high desulphurization rates of the gasoline are required, i.e. if the desulphurized gasoline must contain at most 10% of the sulphur present in the initial gasoline and optionally at most 5% or even at most 2% of the sulphur present in the initial gasoline, which corresponds to desulphurization rates in excess of 90% or even higher than 95 or 98%.

The process according to the invention comprises at least the following steps:

a1) at least one step, which consists in feeding the feedstock, preferably comprising the whole gasoline cut, across a catalyst enabling the diolefins and acetylenic compounds in the gasoline to be selectively hydrogenated without hydrogenating the olefins, a2) optionally, at least one optional step which consists in feeding at least part of the initial gasoline or the gasoline hydrogenated at step a1, preferably all of the initial or hydrogenated gasoline from step a1, across a catalyst enabling at least part of the light sulphur compounds (for example: ethyl mercaptan, propyl mercaptan, thiophen) to be transformed, together with at least a part of the diolefins or olefins, into heavier sulphur compounds. This step is preferably operated simultaneously with step a1, for example by feeding the initial gasoline across a catalyst that is capable of both hydrogenating the diolefins and acetylenics and of converting the light sulphur compounds and a part of the diolefins or olefins into heavier sulphur compounds, or across a separate catalyst but one which enable this transformation to occur in the same reactor as that used for step a1. Optionally, with certain types of feedstock, an increase in the mercaptan content after a1) or a2) may possibly be observed, this increase in the mercaptan content probably being due to hydrogenolysis of disulphides with a high molecular weight. During this step, all of the light sulphur compounds, i.e. the compounds whose boiling point is lower than that of thiophen, may be transformed. Of these compounds, mention may be made of $CS_2$, dimethyl sulphide, methylethyl sulphide or COS.

b) at least one step with a view to separating the initial gasoline into at least a light gasoline (light fraction), at least one intermediate gasoline (intermediate fraction) and a heavy gasoline (heavy fraction). The cut point of the light gasoline is determined with a view to limiting the sulphur content of the light gasoline and enabling it to be used in the gasoline pool, preferably without any additional treatment, in particular without desulphurization. The cut point of the intermediate gasoline is generally determined by the restrictions imposed by the reforming process in which the latter will be treated. One of the preferred configurations is to fractionate the gasoline in order to obtain a light fraction, a heavy fraction and two intermediate gasolines: a first intermediate gasoline mainly consisting of compounds with six carbon atoms, which is then preferably mixed with the heavy fraction of gasoline, preferably prior to step c1 or optionally between the saturation treatment of unsaturated sulphur compounds (step c1) and the decomposition of these compounds (step c2), and a second intermediate gasoline mainly comprising molecules having 7 or 8 carbon atoms ($C_7$ or $C_8$) which is treated at step d.

c1) at least one step, which consists in treating at least a part of the heavy gasoline and optionally at least a part of the intermediate cuts on a catalyst enabling at least some of the unsaturated sulphur compounds present in said feedstock, such as the thiophen compounds for example, to be converted into saturated sulphur compounds such as thiophanes (or thiacyclopentane) or mercaptans for example, in a series of reactions as described below:

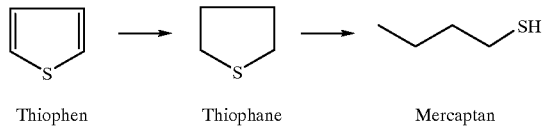

It is also possible to operate a total decomposition reaction during which $H_2S$ is released, generally accompanied by significant saturation reactions of the unsaturated sulphur compounds.

This hydrogenation reaction may be operated on any catalyst conducive to these reactions such as a catalyst containing at least one metal from Group VIII and/or at least one metal from group VIb, preferably at least partially in the form of sulphides. When using such a catalyst, the operating conditions are adjusted so that at least some of the unsaturated compounds, such as the thiophen compounds, can be hydrogenated whilst limiting hydrogenation of the olefins.

c2) following this treatment, at least one step c2 may be operated, in which the saturated sulphur compounds present in the initial gasoline or obtained after the saturation reaction (step c1) are converted into $H_2S$ by the reactions given as examples below:

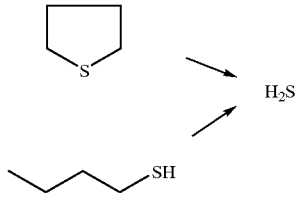

This treatment may be operated on any catalyst enabling the saturated sulphur compounds (mainly compounds of the thiophane type or mercaptan type) to be converted. For example, the catalyst used may have a base of at least one metal from group VIII of the old periodic table (groups 8, 9 or 10 of the new periodic table).

The heavy gasoline thus desulphurized is then optionally stripped (i.e. a gaseous flow, preferably containing an inert gas or gases, is fed through this gasoline) in order to remove the $H_2S$ produced during the hydro-desulphurization process. The light gasoline separated at step b and the heavy gasoline desulphurized at step c1 and/or at step c2 may then optionally either be mixed and fed into the gasoline pool of the refinery or treated separately without being mixed.

d) treatment of at least one of the intermediate cuts by a process intended to remove virtually all of the sulphur and nitrogen compounds from this fraction and preferably to hydrogenate all of the olefins, after which the effluent thus hydro-treated is treated on a reforming catalyst to enable the paraffins to be isomerized and dehydrocyclized.

e) optionally a step e at which at least two fractions are mixed, one of which, at least, having been subjected to a desulphurization treatment at step c1 and optionally c2 and/or at step d.

The different steps of the process according to the invention will be described in more detail below.

Hydrogenation of the Diolefins and Acetylenics (Step a1):

The step of hydrogenating the dienes enables almost all the dienes present in the gasoline cut containing the sulphur to be treated to be removed prior to hydro-desulphurization. It preferably takes place during the first step (step a1) of the process proposed by the invention, generally in the presence of a catalyst containing at least one metal from group VIII, preferably selected from the group consisting of platinum, palladium and nickel, and a substrate. For example, the catalyst used will have a base of nickel or palladium deposited on an inert substrate such as alumina or silica, for example, or a substrate containing at least 50% alumina.

The pressure applied is sufficient to maintain more than 60%, preferably 80% and a more preferably 95% by weight of the gasoline to be treated in liquid phase inside the reactor; generally speaking, it is between approximately 0.4 and approximately 5 MPa and preferably higher than 1 MPa and even more preferably between 1 and 4 MPa. The spatial velocity per hour of the liquid to be treated is between approximately 1 and approximately 20 $h^{-1}$ (feedstock volume per catalyst volume per hour), preferably between 3 and 10 $h^{-1}$ and more preferably between 4 and 8 $h^{-1}$. The temperature is more generally between approximately 50 and approximately 250° C. and preferably between 80 and 230° C. and more preferably between 150 and 200° C., so as to guarantee sufficient conversion of the olefins. By very particular preference, it is limited to at most 180° C. The hydrogen to feedstock ratio expressed in litres is generally between 5 and 50 litres per litre, preferably between 8 and 30 litres per litre.

The choice of operating conditions is of particular importance. More generally, operation is at a pressure and in the presence of a quantity of hydrogen slightly in excess of the stoichiometric value needed to hydrogenate the diolefins and acetylenics. The hydrogen and the feedstock to be treated are injected as ascending or descending flows into a reactor which preferably contains a fixed bed of catalyst.

Another metal may be used with the main metal to form a bimetallic catalyst, such as molybdenum or tungsten for example. The use of such catalytic formulas was claimed in patent FR 2 764 299, for example.

Gasoline from catalytic cracking may contain up to a few % by weight of diolefins. After hydrogenation, the diolefin content is generally reduced to less than 3000 ppm, even less than 2500 ppm and more preferably less than 1500 ppm. In certain cases, less than 500 ppm may be obtained. The diene content after selective hydrogenation maybe reduced to less than 250 ppm if necessary.

In one particular embodiment of the process according to the invention, the step of hydrogenating the dienes takes place in a hydrogenation catalytic reactor which has a catalytic reaction zone through which the entire feedstock is fed together with the quantity of hydrogen needed to induce the desired reactions.

Transformation of Light Sulphur Compounds into Heavier Compounds (Step a2):

This optional step consists in transforming the light sulphur compounds which would be found in the light gasoline at the end of separation step b if this step were omitted. It is preferably operated on a catalyst containing at least one element from group VIII (groups 8, 9 and 10 of the new periodic table) or containing a resin. In the presence of this catalyst, the light sulphur compounds are converted into heavier sulphur compounds, entrained in the heavy gasoline.

This optional step may be operated simultaneously with step a1. For example, it may be of particular advantage to operate, during hydrogenation of the diolefins and acetylenics, under conditions such that at least a part of the compounds present in the form of mercaptans are converted. Accordingly, the mercaptan content will be reduced to a certain degree. The hydrogenation procedure used for dienes described in patent application EP-A-0 832 958 maybe used for this purpose, which advantageously uses a catalyst with a palladium base, or that described in patent FR 2 720 754.

Another option is to use a catalyst with a nickel base identical to or different from the catalyst used in step a1, such as the catalyst recommended in the process described in patent U.S. Pat. No. 3,691,066, for example, which enables mercaptans (butyl mercaptan) to be converted into heavier sulphur compounds (methyl thiophen).

Another possible way of operating this step is to hydrogenate at least some of the thiophen to produce thiophane, which has a higher boiling point than thiophen (boiling point of 121° C.). This step may be operated using a catalyst with a nickel, platinum or palladium base. This being the case, the temperatures will generally be between 100 and 300° C. and preferably between 150 and 250° C. The $H_2$feedstock ratio is adjusted to between 1 and 20 litres per litre, preferably between 2 and 15 litres per litre, to permit the desired hydrogenation of the thiophenic compounds whilst minimising hydrogenation of the olefins present in the feedstock. The spatial velocity is generally between 1 and 10 $h^{-1}$, preferably between 2 and 4 $h^{-1}$ and the pressure between 0.5 and 5 MPa, preferably between 1 and 3 MPa. During this step, regardless of which process is used, some of the light sulphur compounds such as the sulphides (dimethyl sulphide, methylethyl sulphide), $CS_2$ and COS may also be converted.

Another possible way of operating this step is to feed the gasoline across a catalyst having an acid function which will induce an addition reaction of the sulphur compounds present as mercaptans on the olefins and cause alkylation of the thiophen by these same olefins. For example, the gasoline to be treated may be fed through an ion-exchanger resin such as a sulphonic resin. The operating conditions will be adjusted to bring about the desired transformation whilst limiting parasitic oligomerization reactions by the olefins. Operation is generally in the presence of a liquid phase at a temperature ranging between 10 and 150° C. and preferably between 10 and 70° C. The operating pressure ranges between 0.1 and 2 MPa and preferably between 0.5 and 1 MPa. The spatial velocity is generally between 0.5 and 10 $h^{-1}$ and preferably between 0.5 and 5 $h^{-1}$. During this step, the conversion rate of the mercaptans is generally in excess of 50% and the conversion rate of the thiophen is generally in excess of 20%.

In order to minimise the oligomerization action of the acid catalyst optionally used, a known compound may be added to the gasoline to inhibit the oligomerizing action of the acid catalysts, such as alcohols, ethers or water for example.

Separation of the Gasoline into at Least Three Fractions (Step b):

During this step, the gasoline is fractionated into at least three fractions:

- a light fraction with a residual sulphur content preferably limited to 50 ppm, more preferably limited to 25 ppm and even more preferably limited to 10 ppm, preferably enabling this cut to be used without any further treatment to reduce its sulphur content,
- at least one intermediate fraction with a relatively low content of olefins and aromatics,
- a heavy fraction in which the greater part of the sulphur initially present in the feedstock is concentrated.

This separation is preferably operated using a conventional distillation column, also known as a splitter. This fractionation column must be capable of splitting off from the gasoline a light fraction containing a small fraction of the sulphur, at least one intermediate fraction mainly consisting of compounds with 6 to 8 carbon atoms and a heavy fraction containing the greater part of the sulphur initially present in the initial gasoline.

This column generally operates at a pressure ranging between 0.1 and 2 MPa and preferably between 0.2 and 1 MPa. The number of theoretical plates of this separating column is generally between 10 and 100 and preferably between 20 and 60. The reflux rate of the column, expressed as the ratio between the liquid flow rate in the column and the feedstock flow rate, is generally less than one unit and preferably less than 0.8, these flow rates being measured in kilograms per hour (kg/h).

The light gasoline obtained after separation generally contains at least all the $C_5$ olefins, preferably all the $C_5$ compounds, and at least 20% of the $C_6$ olefins. Generally speaking, this light fraction has a low sulphur content (less than 50 ppm for example), i.e. it is not generally necessary to treat the light fraction prior to using it as a fuel. However, in certain extreme cases, it might be conceivable to treat the light gasoline by softening Hydrogenation of the Unsaturated Sulphur Compounds (Step c1):

This step is applied to the heavy gasoline optionally mixed with a least a part of an intermediate fraction obtained after the separation step b. By preference, this intermediate fraction essentially consists (i.e. more than 60% by weight, preferably more than 80% by weight) of $C_6$ or $C_7$ molecules and the greater part of the sulphur compounds with a boiling point close to that of the azeotrope of the thiophen with paraffins, give or take approximately 20%. This step consists in converting at least some of the unsaturated sulphur compounds, such as the thiophenic compounds, into saturated compounds, for example into thiophanes (or thiacyclopentanes) or mercaptans or alternatively optionally hydrogenolyzing these unsaturated sulphur compounds, at least partially, to form $H_2S$.

This step may be operated, for example, by feeding the heavy fraction, optionally mixed with at least some of an intermediate fraction, through a catalyst containing at least one element from group VIII and/or at least one element from group VIb at least partially in sulphide form, in the presence of hydrogen, at a temperature ranging between approximately 200° C. and approximately 350° C., preferably between 220° C. and 290° C., at a pressure generally ranging between 1 and approximately 4 MPa, preferably between 1.5 and 3 MPa. The spatial velocity of the liquid ranges between approximately 1 and approximately 20 $h^{-1}$ (expressed as liquid volume per catalyst volume and per hour), preferably between 1 and 10 $h^{-1}$, more especially preferably between 3 and 8 $h^{-1}$. The $H_2$/HC ratio is between 50 and 600 litres per litre and preferably between 300 and 600 litres per litre.

To hydrogenate the unsaturated sulphur compounds in the gasoline, at least partially, using the process according to the invention, at least one catalyst is generally used, containing at least one element from group VIII (metals from groups 8, 9 and 10 of the new periodic table, i.e. iron, ruthenium, osmium, cobalt, rhodium, iridium, nickel, palladium or platinum) and/or at least one element from group VIb (metals from group 6 of the new periodic table, i.e. chromium, molybdenum or tungsten), on an appropriate substrate.

The content of metal from group VIII expressed as an oxide is generally between 0.5 and 15% by weight, preferably between 1 and 10% by weight. The content of metal from group VIb is generally between 1.5 and 60% by weight, preferably between 3 and 50% by weight.

If one is used, the element from group VIII is preferably cobalt and the element from group VIb, if one is used, is generally molybdenum or tungsten. Combinations such as cobalt-molybdenum are preferred. The catalyst substrate is usually a porous solid such as an alumina, a silica-alumina or other porous solids, for example, such as magnesia, silica or titanium oxide, alone or mixed with alumina or silica-alumina. In order to reduce hydrogenation of the olefins present in the heavy gasoline to a minimum, it is of advantage to use by preference a catalyst in which the density of molybdenum, expressed as a % by weight of $MoO_3$ per unit of surface area is greater than 0.07 and preferably greater than 0.10. The catalyst proposed by the present invention preferably has a specific surface area of less than 190 $m^2/g$, more preferably less than 180 $m^2/g$, and more especially preferably less than 150 $m^2/g$.

After introducing the element or elements and optionally shaping the catalyst (if this step is operated with a mixture which already contains the base elements), the catalyst is activated in an initial step. This activation may be effected either by oxidation followed by reduction or by direct reduction or by calcination only. The calcination step is generally operated at temperatures ranging from approximately 100 to approximately 600° C. and preferably ranging between 200 and 450° C., with an air flow. The reduction step is operated under conditions that will enable at least some of the oxidised forms of the metal from group VIII and/or the metal from group VIb to be converted to the metallic state. Generally speaking, it consists in treating the catalyst in a flow of hydrogen at a temperature of preferably less than or equal to 300° C. The reduction may be effected, at least partly, by means of chemical reducers.

The catalyst is preferably used, at least partially, in its sulphide form. The sulphur may be introduced before or after any activation step, i.e. calcination or reduction. By preference, no oxidation step is effected until the sulphur or a sulphur compound has been introduced onto the catalyst.

Accordingly, if sulphur is added to the catalyst after drying, for example, it is preferable not to calcine the catalyst whereas a reduction step may optionally be run after sulphurization.

The sulphur or a sulphur compound may be introduced ex situ, i.e. externally to the reactor in which the process according to the invention takes place, or m situ, i.e. inside the reactor used for the process according to the invention. In the latter case, the catalyst is preferably reduced under the conditions described above before adding sulphur by feeding in a feedstock containing at least one sulphur compound which, once decomposed, will cause sulphur to fix on the catalyst. This feedstock may be gaseous or liquid, for example hydrogen containing $H_2S$ or a liquid containing at least one sulphur compound.

By preference, the sulphur compound is added to the catalyst ex situ. For example, after the calcination step, a sulphur compound may be introduced onto the catalyst, optionally in the presence of another compound. The catalyst is then dried before being transferred to the reactor used to implement the process according to the invention. In this reactor, the catalyst is then treated with hydrogen in order to transform at least some of the main metal into sulphide. A procedure which is particularly well suited to the invention is that described in patents FR-B-2 708 596 and FR-B-2 708 597.

During the process of the invention, the conversion rate of unsaturated sulphur compounds is higher than 15% and preferably in excess of 50%. At the same time, the hydrogenation rate of the olefins is preferably less than 50%, more preferably less than 40% and even more preferably less than 35% during this step.

During the process of the invention, the gasoline treated during step c1 may optionally contain at least some of at least one intermediate fraction obtained during step b. For example, it may be of advantage during this step to treat a fraction of the gasoline which will not be fed to the catalytic reforming process.

The effluent resulting from this first hydrogenation step is then optionally directed to step c2, which enables the saturated sulphur compounds to be decomposed to produce $H_2S$.

Decomposition of the Saturated Sulphur Compounds (Step c2):

The feedstock at this stage consists either of the effluent issuing from step c1 only or a mixture comprising the effluent from step c1 and at least some of at least one intermediate fraction. By preference, this intermediate fraction essentially (i.e. more than 60% by weight, preferably more than 80% by weight) consists of $C_6$ or C7 molecules as well as the greater part of the sulphur compounds with a boiling point close to that of the azeotrope of thiophen with the hydrocarbons, give or take 20%.

During this step, the saturated sulphur compounds are transformed in the presence of hydrogen on an appropriate catalyst. The unsaturated compounds that were not hydrogenated during step c1 may also be decomposed simultaneously. This transformation takes place without significantly hydrogenating the olefins, i.e. during this step, the quantity of hydrogenated olefins is generally limited to less than 20% by volume relative to the olefins contained in the initial gasoline and preferably limited to 10% by volume relative to the olefins contained in the initial gasoline.

Catalysts which might be suitable for this step of the process according to the invention, although this list is not restrictive, are catalysts which generally contain at least one base element (metal) selected from the group VIII elements and preferably selected from the group consisting of nickel, cobalt, iron, molybdenum, tungsten. These metals may be used alone or in combination, are preferably applied to a substrate and are used in their sulphide form. It is also possible to add at least one promoter to these metals, for example tin. By preference, the catalysts used will contain nickel or nickel and tin or nickel and iron or cobalt and iron or alternatively cobalt and tungsten. Said catalysts are more preferably sulphurized and are very preferably presulphurized in situ or ex situ. The catalyst used for step c2 is preferably of a different nature and/or composition from that used for step c1.

The content of base metal in the catalyst used for the process according to the invention generally ranges between approximately 1 and approximately 60% by weight, preferably between 5 and 20% by weight and even more preferably between 5 and 9%. By preference, the catalyst is generally shaped, preferably in the form of beads, pellets, of extruded for example as trilobes. The metal may be incorporated in the catalyst by depositing it on the pre-formed substrate and may also be mixed with the substrate prior to the shaping step. The metal is generally introduced in the form of a precursor salt, generally soluble in water, such as nitrates, heptamolybdates, for example. This process of introduction is not specific to the invention. Any other process of introduction known to the person skilled in the art may be used.

The catalyst substrates used in this step of the process according to the invention are generally porous solids selected from the refractory oxides such as alumina, silica and silica-alumina, magnesia, for example, as well as titanium oxide and zinc oxide, it being possible to use these latter oxides alone or mixed with alumina or silica-alumina By preference, the substrates are transition alumina or silica with a specific surface area ranging between 25 and 350 $m^2/g$. Natural compounds such as diatomaceous earth or kaolin may also be suitable substrates for the catalysts used for this step of the process.

In a preferred mode of preparing the catalyst, after at least one metal or precursor of said metal has been introduced and the catalyst optionally shaped, the catalyst is activated in a first step. This activation may be effected either by oxidation followed by reduction or by reduction after drying without calcination, or alternatively by calcination only. If calcination is used, the temperatures generally range from approximately 100° C. to approximately 600° C. and preferably range between 200° C. and 450° C., with a flow of air. The reduction step is operated under conditions that will enable at least some of the oxidised form s of the base metal to be converted to the metallic state. Generally speaking, it consists of treating the catalyst under a flow of hydrogen at a temperature at least equal to 300° C. The reduction may also be at least partially operated using chemical reducers.

The catalyst is preferably used, at least partially, in its sulphurized form, which has the advantage of limiting to a maximum any risk of hydrogenation of the unsaturated compounds such as olefins or aromatic compounds during the start-up phase. The sulphur may be introduced between different activation steps. By preference, no oxidation step is operated until the sulphur or a sulphur compound has been introduced onto the catalyst. The sulphur or a sulphur compound may be introduced ex situ, i.e. externally to the reactor in which the process according to the invention takes place, or in situ, i.e. inside the reactor used for the process according to the invention. In the latter case, the catalyst is preferably reduced under the conditions described above before adding sulphur by feeding in a feedstock containing at least one sulphur compound which, once decomposed, will cause sulphur to fix on the catalyst. This feedstock may be gaseous or liquid, for example hydrogen containing $H_2S$ or a liquid containing at least one sulphur compound.

By preference, the sulphur compound is added to the catalyst ex situ. For example, after the calcination step, a sulphur compound may be introduced onto the catalyst, optionally in the presence of another compound. The catalyst is then dried before being transferred to the reactor used to implement the process according to the invention. In this reactor, the catalyst is then treated with hydrogen in order to transform at least some of the base metal and optionally another metal into sulphide. A procedure which is particularly well suited to the invention is that described in patents FR-B-2 708 596 and FR-B-2 708 597.

After sulphurization, the sulphur content of the catalyst is generally between 0.5 and 25% by weight, preferably between 4 and 20% by weight and even more preferably between 4 and 10% by weight. The purpose of the hydrosulphurization process operated during this step c2 is to convert to $H_2S$ the saturated sulphur compounds of the gasoline which were subjected to at least one hydrogenation process before the unsaturated sulphur compounds during step c1. This enables an effluent to be obtained which meets the desired specifications in terms of content of sulphur compounds. The resultant gasoline undergoes only a slight loss of octane (drop in the Research and/or Motor Octane Number).

The treatment intended to decompose the saturated sulphur compounds after step c1 of the process is operated in the presence of hydrogen with a catalyst containing at least one base metal selected from the group consisting of nickel, cobalt, iron, molybdenum and tungsten, used alone or mixed with one another, at a temperature ranging between approximately 100° C. and approximately 400° C., preferably between approximately 150° C. and approximately 380° C., more especially preferably between 210° C. and 360° C. and most preferably between 220° C. and 350° and a pressure generally ranging by preference between approximately 0.5 and approximately 5 MPa, preferably between 1 and 3 MPa, more preferably between 1.5 and 3 MPa. The spatial velocity of the liquid ranges between approximately 0.5 and approximately 10 $h^{-1}$ (expressed as liquid volume per catalyst volume per hour), preferably between 1 and 8 $h^{-1}$. The $H_2$/HC ratio is adjusted to the desired hydro-desulphurization rates within the range of between approximately 100 and approximately 600 litres per litre, preferably between 20 and 300 litres per litre. All or some of this hydrogen may optionally be drawn from step c1 (unconverted hydrogen) or may be unconsumed hydrogen recycled from steps a1, a2, c2 or d.

It has been found that using this second catalyst for this step, under specific operating conditions, enables the saturated compounds contained in the effluent issuing from step c1 to be decomposed into $H_2S$. This approach enables a high global level of desulphurization to be obtained at the end of all the steps of the process according to the invention whilst minimising the octane loss resulting from saturation of the olefins because the olefin conversion during step c1 is generally limited to at most 20% by volume of the olefins, preferably at most 10% by volume.

Hydro-Treatment of at Least One Intermediate Cut (Step d):

This treatment of at least one of the intermediate cuts is intended to eliminate virtually all the sulphur and nitrogen compounds from this fraction and to treat the effluent hydro-treated in this manner on a reforming catalyst to enable the paraffins to be isomerized and dehydrocyclized. This step is applied to at least a part of an intermediate fraction obtained from step b.

It consists in treating said fraction on a catalyst or on a series of catalysts, i.e. obtaining a fraction with a content of sulphur and nitrogen that is preferably less than 5 ppm and more preferably less than 1 ppm by weight by converting the sulphur or nitrogen compounds into $H_2S$ and ammonia respectively.

This step is generally operated by feeding the fraction through at least one conventional hydro-treatment catalyst under conditions that will enable sulphur and nitrogen to be eliminated. Particularly suitable catalysts are, for example, catalysts with a base of a metal from group VIII such as cobalt or nickel and a metal from group VI such as tungsten or molybdenum. Typically, although these conditions are not restrictive, this treatment may be operated on a catalyst of the HR 306 or HR 448 type sold by Procatalyse, at a temperature generally ranging between 250 and 350° C., an operating pressure generally ranging between 1 and 5 MPa, preferably between 2 and 4 MPa, and a spatial velocity generally ranging between 2 and 8 $h^{-1}$ (expressed as volume of liquid feedstock per catalyst volume per hour). During this treatment, almost all of the olefins present in this fraction are hydrogenated.

The resultant effluent is cooled and the decomposition products are then separated using any technique known to the person skilled in the art. Conceivable processes would be washing, stripping or alternatively extraction, for example.

The effluent corresponding to one of the intermediate fractions from which the sulphur and nitrogen have been removed is then treated on a catalyst or a series of catalysts to enable said fraction to reform, i.e. to bring about at least partial dehydrogenation of the saturated cyclic compounds, isomerize the paraffins and dehydrocyclize the paraffins present in the intermediate fraction treated. This treatment is intended to increase the octane number of the respective fraction. This process is operated using a conventional catalytic reforming process. It may be of advantage to use "fixed bed" or "fluidized bed" processes for this purpose, in which the catalyst is disposed respectively in a fixed or alternatively fluidized bed and optionally circulated through at least one reactor and through an external circulation loop optionally incorporating other reactors and/or at least one re-generator. During implementation of the process, the desulphurized effluent is brought into contact with a reforming catalyst, generally having a platinum base on an alumina substrate, at a temperature ranging between 400° C. and 700° C. at an hourly spatial velocity (kg of treated feedstock per hour and per kg of catalyst) ranging between 0.1 and 10. The operating pressure may range between 0.1 and 4 MPa. Some of the hydrogen produced during the different reactions may be recycled in a ratio of between 0.1 and 10 moles of hydrogen per mole of feedstock.

FIG. 1 illustrates an example of one embodiment of the process according to the invention. In this example, a gasoline cut (initial gasoline) containing sulphur is introduced via line 1 into a catalytic hydrogenation reactor 2, which enables the diolefins and/or the acetylenic compounds present in said gasoline cut to be selectively hydrogenated (step a1 of the process). The effluent 3 from the hydrogenation reactor is fed into a reactor 4, which contains a catalyst capable of converting the light sulphur compounds together with the diolefins or olefins into heavier sulphur compounds (step a2). The effluent 5 from the reactor 4 is then fed to the fractionation column 6 enabling the gasoline to be separated into 3 fractions (step b).

The first fraction obtained is a light fraction 7. This light cut preferably contains less than 50 ppm of sulphur and does not need to be desulphurized because the light sulphur compounds present in the initial gasoline were converted into heavier compounds during step a2.

A second fraction 8 (intermediate fraction) is obtained, which is firstly fed to a catalytic desulphurization reactor 10 and then via line 11 to a catalytic reforming reactor (step d).

A third fraction (heavy fraction) is obtained via line 9. This cut is firstly treated in a reactor 14 on a catalyst that will enable at least some of the unsaturated sulphur compounds present in the feedstock to be converted into saturated sulphur compounds (step c1). The effluent 15 from the reactor 14 is fed to the reactor 16 (step c2) which contains a catalyst to promote decomposition of the saturated sulphur compounds initially present in the feedstock and/or formed in the reactor 14 into $H_2S$.

The light cut 7 as well as the effluent 13 (from the reforming reactor 14) and the effluent 17 (from the decomposition reactor 13) are mixed to form the desulphurized gasoline 18 (step e).

Using other, preferred implementing processes, illustrated in FIG. 1, it is also possible to direct at least a part of the intermediate fraction that was not desulphurized (line 8) either via line 19 and then mixed with the heavy fraction 9 to the reactor 14 (step c1) or via line 20 and then mixed with the effluent 15 to the reactor 16 (step c2).

The invention is illustrated by the examples below.

EXAMPLE 1

(Comparative)

A gasoline obtained by catalytic cracking, the characteristics of which are set out in table 1, is treated with a view to obtaining a specification for the gasoline pool at the refinery outlet such that its sulphur content is less than 10 ppm, which means reducing the sulphur contained in a gasoline leaving a catalytic cracking unit must be reduced to less than 20 ppm by weight.

The gasoline is separated into three cuts, a light cut with a distillation range of between 35° C. and 95° C., an intermediate cut with a distillation range of between 95° C. and 150° C. and a heavy cut with a distillation range of between 150° C. and 250° C.

The sulphur content of the light gasoline, which represents 38% of the total gasoline volume, is 210 ppm by weight.

The intermediate and heavy cuts are treated on a HR306 catalyst sold by Procatalyse. The catalyst (20 ml) is firstly treated to add sulphur for 4 hours at a pressure of 3.4 MPa at 350° C., in contact with a feedstock containing 2% sulphur in the form of dimethyl disulphide in n-heptane. The desulphurization step is operated at 300° C. at 35bar with a $H_2$HC ratio of 150 1/1 and a VVh of 3 $h^{-1}$. Under these processing conditions, the effluents obtained after stripping the $H_2S$ contain 1 ppm of sulphur. The mixture of these two desulphurized cuts with the lighter cut produces a gasoline containing 81 ppm by weight of sulphur.

| | |
|---|---|
| Sulphur (ppm by weight) | 2000 |
| Olefins (% volume) | 30 |
| Aromatics (% volume) | 40 |
| Paraffins + Napthenes (% volume) | 30 |
| RON | 91.0 |
| MON | 81.1 |
| Density | 0.77 |

Distillation

| % Distilled volume | Boiling temperature (° C.) | Sulphur (% cumulative weight) | Olefins (% cumulative weight) |
|---|---|---|---|
| 0 | 35 | 0 | 0 |
| 10 | 55 | 0.8 | 21 |
| 30 | 85 | 2.1 | 52 |
| 50 | 120 | 7.5 | 77 |
| 70 | 155 | 20 | 92 |
| 90 | 200 | 49 | 99 |
| 100 | 240 | 100 | 100 |

EXAMPLE 2

Gasoline from a catalytic cracking unit, the characteristics of which are described in example 1, is treated to hydrogenate the diolefins under conditions in which the light sulphur compounds present in the feedstock are partially converted to heavier compounds (steps a1 and a2 simultaneously).

This treatment is performed in a continuously operating reactor in an ascending flow. The catalyst has a base of nickel and molybdenum (catalyst HR945 sold by Procatalyse). Sulphur is firstly added to the catalysts in a treatment of 4 hours at a pressure of 3.4 MPa at 350° C., in contact with a feedstock containing 2% sulphur in the form of dimethyl disulphide in n-heptane.

The reaction is conducted at 160° C. at a total pressure of 1.3 MPa, with a spatial velocity of 6 $h^{-1}$. The $H_2$/feedstock ratio, express by litre of hydrogen per litre of feedstock is 10.

The gasoline is then separated into two cuts, one having a distillation range of between 35° C. and 80° C. and accounting for 29% of the volume and the other being distilled between 80° C. and 240° C. accounting for 71% by volume of the gasoline cut. The sulphur content of the light gasoline is 22 ppm by weight.

The heavy gasoline is subjected to a hydro-desulphurization process on a series of catalysts in an isothermic tubular reactor. The first catalyst (catalyst A, step c1) is obtained by impregnating <<without excess solution>> a transition alumina in the form of beads having a specific surface area of 130 $m^2$/g and a porous volume of 0.9 ml/g, with an aqueous solution containing molybdenum and cobalt in the form of ammonium heptamolybdate and cobalt nitrate. The catalyst is then dried and calcined in air at 500° C. The cobalt and molybdenum content of this sample is 3% of CoO and 10% of $MoO_3$.

The second catalyst (catalyst B, step c2) is prepared from a transition alumina of 140 $m^2$/g in the form of beads with a 2 mm diameter. The porous volume is 1 ml/g of substrate. 1 kilogram of substrate is impregnated with 1 litre of nickel nitrate solution. The catalyst is then dried at 120° C. and calcined in a flow of air at 400° C. for one hour. The nickel content of the catalyst is 20% by weight.

25 ml of catalyst A and 50 ml of catalyst B are placed in a same hydro-desulphurization reactor so that the feedstock to be treated (heavy fraction) comes firstly into contact with catalyst A (step c1) and then catalyst B (step c2). A zone for drawing off effluent from step c1 is provided between catalysts A and B. Sulphur is firstly added to the catalysts in a 4 hour treatment at a pressure of 3.4 MPa at 350° C. in contact with a feedstock containing 2% sulphur in the form of dimethyl disulphide in n-heptane.

The operating conditions of the hydro-desulphurization process are as follows: VVH=1.33 $h^{-1}$ relative to the catalytic bed as a whole, $H_2$/HC is 360 1/1, P=1.8 MPa. The temperature in the catalytic zone containing catalyst A is 260° C. whilst the temperature of the catalytic zone containing catalyst B is 350° C. The resultant product contains 19 ppm of sulphur.

The desulphurized product is recombined with the light gasoline. The measurement taken on the sulphur content of the gasoline thus obtained shows a content of 20 ppm by weight. It has a RON of 88.1 and a MON of 79.6, i.e. a loss of(RON+MON)/2 of 2.2 points relative to the feedstock. The olefin content of this gasoline is 22% vol.

EXAMPLE 3

(Representing the Invention):

Gasoline from a catalytic cracking unit, the characteristics of which are described in example 1, is treated to hydrogenate the diolefins under conditions in which the light sulphur compounds present in the feedstock are partially converted into heavier compounds (steps a1 and a2 simultaneously).

This treatment is performed in a continuously operating reactor with an ascending flow. The catalyst has a base of nickel and molybdenum (catalyst HR945 sold by Procatalyse). Sulphur is firstly added to the catalysts in a treatment of 4 hours at a pressure of 3.4 MPa at 350° C., in contact with a feedstock containing 2% sulphur in the form of dimethyl disulphide in n-heptane. The reaction is conducted at 160° C. at a total pressure of 1.3 M Pa, with a spatial velocity of 6 $h^{-1}$. The $H_2$/feedstock ratio, expressed by litre of hydrogen per litre of feedstock is 10.

The gasoline is then separated into four cuts:

one having a distillation range of between 35° C. and 80° C. and accounting for 28% vol and having a sulphur content of 20 ppm by weight;

a second cut distilled between 80° C. and 95° C. and representing 10% by volume of the initial gasoline cut and containing 250 ppm by weight of sulphur;

a third cut distilled between 95° C. and 150° C., representing 30% by volume of the initial gasoline and containing 1000 ppm by weight of sulphur. The RON and MON of this cut are 90 and 79 respectively;

a fourth cut distilled between 150° C. and 240° C. representing 32% by volume of the initial gasoline and containing 4600 ppm by weight of sulphur.

The heavy gasoline is mixed with the second cut and subjected to a hydro-desulphurization process on a series of catalysts in an isothermic tubular reactor. The first catalyst (catalyst A, step c) is obtained by impregnating <<without excess solution>> a transition alumina in the form of beads having a specific surface area of 130 $m^2/g$ and a porous volume of 0.9 ml/g, with an aqueous solution containing molybdenum and cobalt in the form of ammonium heptamolybdate and cobalt nitrate. The catalyst is then dried and calcined in air at 500° C. The cobalt and molybdenum content of this sample is 3% of CoO and 10% of $MoO_3$.

The second catalyst (catalyst B, step d) is prepared from a transition alumina of 140 $m^2/g$ in the form of beads with a 2 mm diameter. The porous volume is 1 ml/g of substrate. 1 kilogram of substrate is impregnated with 1 litre of nickel nitrate solution. The catalyst is then dried at 120° C. and calcined in a flow of air at 400° C. for one hour. The nickel content of the catalyst is 20% by weight.

25 ml of catalyst A and 50 ml of catalyst B are placed in a same hydro-desulphurization reactor so that the feedstock to be treated (heavy fraction) comes firstly into contact with catalyst A (step c) and then catalyst B (step d). A zone for drawing off effluent from step c is provided between catalysts A and B. Sulphur is firstly added to the catalysts in a 4 hour treatment at a pressure of 3.4 MPa at 350° C. in contact with a feedstock containing 2% sulphur in the form of dimethyl disulphide in n-heptane.

The operating conditions of the hydro-desulphurization process are as follows: VVH=1.33 $h^{-1}$ relative to the catalytic bed as a whole, $H_2$/HC=360 1/1, P=1.8 MPa. The temperature in the catalytic zone containing catalyst A is 260° C. whilst the temperature of the catalytic zone containing catalyst B is 350° C. The resultant product contains 37 ppm of sulphur.

The third cut is treated on a HR306 catalyst sold by Procatalyse. The catalyst (20 ml) firstly has sulphur added to it in a 4 hour treatment at a pressure of 3.4 MPa at 350° C. in contact with a feedstock containing 2% of sulphur in the form of dimethyl disulphide in n-heptane. The desulphurization step is operated at 300° C. under 3.5 MPa with a $H_2$/HC of 150 1/1 and a VVH of 3 $h^{-1}$. Under these processing conditions, the effluent obtained after stripping the $H_2S$ contains less than 1 ppm of sulphur. The olefin content is 0.9% by volume and the octane values are 68.7 for the RON and 68.3 for the MON. The resultant gasoline is then treated on a CR201 reforming catalyst sold by Procatalyse. The catalyst (30 ml) is firstly reduced at 500° C. in a flow of hydrogen before use. The reforming treatment is operated at 470° C. at a pressure of 7 bar. The $H_2$/HC ratio is 5001/1. The VVH is 2 $h^{-1}$.

The effluent is stabilised by removing compounds having less than 5 carbon atoms. The reformate obtained, which represents 86% of the treated gasoline fraction, has a sulphur content of less than 1 ppm by weight, a RON of 97 and a MON of 86

The fractions resulting from the different treated cuts are re-mixed. The sulphur content is 20 ppm by weight. The mean value (RON+MON)/2 of the total desulphurized gasoline has increased by 1.3 points compared with the initial gasoline. Furthermore, the hydrogen produced during the catalytic reforming step can be used for reaction sections of the hydro-treatment, which is an obvious advantage of the process.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever. The entire disclosure of all applications, patents and publications, cited above and below, and of corresponding French application 00/04.084, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process of producing gasoline with a low sulfur content from a gasoline feedstock containing sulfur compounds, diolefins, olefins, aromatics, nitrogen and acetylenic compounds, said process comprising at least the following steps:

(a1) conducting at least one selective hydrogenation of diolefins and acetylenic compounds contained in the feedstock, wherein in step (a1) the hydrogen to feedstock ratio is 8–30 liters of hydrogen per liter of feedstock, (b) conducting at least one separation of effluent obtained at the end o step (a1) into at least three fractions: a light fraction containing olefins, and from which substantially all of the sulfur has been removed, a heavy fraction in which most of the sulfur compounds initially contained in the gasoline feedstock is concentrated, and at least one intermediate fraction, (c1) conducting at least one treatment of the heavy fraction separated at step (b) on a catalyst enabling the sulfur compounds to be at least partially decomposed or hydrogenated, and (d) conducting at least one step to remove sulfur and nitrogen from at east one intermediate fraction.

2. A process as claimed in claim 1, further comprising at least one step (a2) prior to step (b) of increasing the molecular weight of sulfur compounds present in at least one of the feedstock or the effluent from step (a1).

3. A process according to claim 2, wherein steps (a1) and (a2) are performed simultaneously.

4. A process as claimed in claim 1, further comprising a step (c2) of treating effluent from step (c1) on a catalyst to decompose sulfur compounds.

5. A process as claimed in claim 4, in which the hydrogenation of olefins in said effluent of(c1) is limited to less than 20% by volume.

6. A process as claimed in claim 4, further comprising a step (e) of mixing at least two of said fractions, at least one of which was desulfurized at step (c1) and optionally (c2), or step (d).

7. A process as claimed in claim 4, in which step (b) comprises separating effluent obtained from step (a1) into four fractions: a light action, a heavy fraction and two intermediate fractions, treating one of the intermediate fraction at step (d), and mixing the other intermediate fraction with the heavy fraction separated at step (b) before said heavy fraction is treated in step (c1) and/or step (c2).

8. A process according to claim 4, wherein steps (c1) and (c2) are performed in a single reactor.

9. A process according to claim 4, wherein steps (c1) and (c2) are performed in two separate reactors.

10. A process as claimed in claim 1, in which a part of at least one intermediate fraction obtained from step (b) is mixed with the heavy fraction from step (b) prior to step (c1).

11. A process as claimed in claim 1, in which a part of at least one intermediate fraction obtained at step (b) is mixed with effluent from step (c1).

12. A process as claimed in claim 1, in which step (d) during which sulphur and nitrogen are removed, further comprises hydrogenation of the olefins.

13. A process as claimed in claim 1, in which the feedstock is a gasoline cut from a catalytic cracking unit.

14. A process according to claim 1, further comprising subjecting effluent from at least one intermediate fraction of step (d) to catalytic reforming.

15. A process according to claim 1, wherein the sulfur compounds in the gasoline feedstock comprise ethyl mercaptan, propyl mercaptan, thiophen, $CS_2$, dimethyl sulphide, methylethyl sulphide, or COS.

16. A process according to claim 1, wherein the sulfur compounds in the gasoline feedstock comprise compounds with a boiling point lower than thiophen.

17. A process as claimed in claim 1, further comprising at least one step (a2) prior to step (b) of increasing the molecular weight of sulfur compounds present in the effluent from step (a1).

18. A process as claimed in claim 17, in which a part of at least one intermediate fraction obtained from step (b) is mixed with the heavy fraction from step (b) prior to step (c1).

19. A process as claimed in claim 17, in which step (b) comprises separating effluent obtained from step (a1) into four fractions: a light action, a heavy fraction and two intermediate fractions, treating one of the intermediate fractions at step (d), and mixing the other intermediate fraction with the heavy fraction separated at step (b) before said heavy fraction is treated in step (c1) and/or step (c2).

20. A process of producing gasoline with a low sulfur content from a gasoline feedstock comprising sulfur compounds, diolefins, olefins, aromatics, nitrogen and acetylenic compounds, said process comprising at least the following steps:

(a1) conducting at least one selective hydrogenation of diolefins and acetylenic compounds comprised in the feedstock, wherein in step (a1) the hydrogen n to feedstock ratio is 8–30 liters of hydrogen per liter of feedstock, (a2) increasing the molecular weight of sulfur compounds present in at least one of the feedstock or the effluent from step (a1), (b) conducting at least one separation of effluent obtained at the end of step (a1) or (a2) into at least three fractions: a light fraction comprising olefins, and from which substantially all of the sulfur has been removed, a heavy fraction in which most of the sulfur compounds initially comprised in the gasoline feedstock is concentrated, and at least one intermediate fraction, (c1) conducting at least one treatment of the heavy fraction separated at step (b) on a catalyst enabling the sulfur compounds to be at least partially decomposed or hydrogenated, (d) conducting at least one step to remove sulfur and nitrogen from at least one intermediate fraction, and (e) mixing at least two of the fractions, at least one of which was desulfurized at step (c1) or step (d).

21. A process according to claim 20, wherein step (a2) is performed on the effluent of step (a1).

22. A process as claimed in claim 21, in which a part of at least one intermediate fraction obtained from step (b) is mixed with the heavy fraction from step (b) prior to step (c1).

23. A process as claimed in claim 21, in which a part of at least one intermediate fraction obtained at step (b) is mixed with effluent from step (c1) prior to step (c2).

24. A process of producing gasoline with a low sulfur content from a gasoline feedstock comprising sulfur compounds, diolefins, olefins, aromatics, nitrogen and acetylenic compounds, said process comprising at least the following steps:

(a1) conducting at least one selective hydrogenation of diolefins and acetylenic compounds comprised in the feedstock, wherein in step (a1) the hydrogen n to feedstock ratio is 8–30 liters of hydrogen per liter of feedstock, (a2) increasing the molecular weight of sulfur compounds present in to least one of the feedstock or the effluent from step (a1), (b) conducting at least one separation of effluent obtained at the en of step (a1) or (a2) into at least three fractions: a light fraction comprising olefins, and from which substantially all of the sulfur has been removed, a heavy fraction in which most of the sulfur compounds initially comprised in the gasoline feedstock is concentrated, and at least one intermediate fraction having a depleted content of olefins and aromatics, (c1) conducting at least one treatment of the heavy fraction separated at step (b) on a catalyst enabling the sulfur compounds to be at least partially decomposed or hydrogenated, (c2) treating effluent from step (c1) on a catalyst so as to decompose the sulfur compounds, and (d) conducting at least one step to remove sulfur and nitrogen from at least one intermediate fraction, wherein a part of said at least one intermediate fraction obtained from step (b) is mixed with the heavy fraction prior to step (c1).

25. A process as claimed in claim 24, in which a part of at least one intermediate fraction obtained at step (b) is mixed with effluent from step (c1) prior to step (c2).

26. A process according to claim 24, wherein step (a2) is performed on the effluent of step (a1).

27. A process of producing gasoline with a low sulfur content from a gasoline feedstock comprising sulfur compounds, diolefins, olefins, aromatics, nitrogen and acetylenic compounds, said process comprising at least the following steps (a1) conducting at least one selective hydrogenation of diolefins and acetylenic compounds comprised in the feedstock, wherein in step (a1) the hydrogen to feedstock ratio is 8–30 liters of hydrogen per liter of feedstock, (a2) increasing the molecular weight of sulfur compounds present in at least one of the feedstock or the effluent from step (a1), (b) conducting at least one separation of effluent obtained at the end of step (a1) or (a2) into at least three fractions: a light fraction comprising olefins, and from which substantially all of the sulfur has been removed, a heavy fraction in which most of the sulfur compounds initially comprised in the gasoline feedstock is concentrated, and at least one intermediate fraction, (c1) conducting at least one treatment of the heavy fraction separated a step (b) on a catalyst enabling the sulfur compounds to be at least partially decompose or hydrogenated, and mixing a part of at least one intermediate fraction obtained at step (b) with effluent from step (c1), (c2) treating effluent from step (c1) on a catalyst so as to decompose the sulfur compounds, and (d) conducting at least one step to remove sulfur and nitrogen from at least one intermediate fraction.

28. A process according to claim 27, wherein step (a2) is performed on the effluent of step (a1).

29. A process for producing gasoline with a low sulfur content from a gasoline feedstock comprising:

conducting at least one selective hydrogenation of diolefins and acetylenic compounds comprised in the feedstock, wherein in said at least one selective hydrogenation the hydrogen to feedstock ratio is 8–30 liters of hydrogen per liter of feedstock;

separating an effluent of the at least one selective hydrogenation into at least three fractions; and conducting at least one treatment of one of the fractions separated on a catalyst enabling the sulfur compounds to be at least partially decomposed or hydrogenated, removing sulfur and nitrogen from at least one of the separated fractions.

30. A process according to claim 29, further comprising increasing the molecular weight of sulfur compounds present in at least one of the feedstock or the effluent from the selective hydrogenation.

31. A process according to claim 29, wherein the fractions comprise a light fraction, an intermediate fraction, and a heavy fraction.

32. A process for producing gasoline with a low sulfur content from a gasoline feedstock comprising:

conducting at least one selective hydrogenation of diolefins and acetylenic compounds comprised in the feedstock, wherein in said at least one selective hydrogenation the hydrogen to feedstock ratio is 8–30 liters of hydrogen per liter of feedstock;

separating an effluent of the at least one selective hydrogenation into at least three fractions; and removing sulfur and nitrogen from at least one of the separated fractions.

33. A process according to claim 32, further comprising increasing the molecular weight of sulfur compounds present in at least one of the feedstock or the effluent from the selective hydrogenation.

34. A process according to claim 32 wherein the fractions comprise a light fraction, an intermediate fraction, and a heavy fraction.

35. A process of producing gasoline with a low sulfur content from a gasoline feedstock containing sulfur compounds, diolefins, olefins, aromatics, nitrogen and acetylenic compounds, said process comprising at least the following steps:

(a1) conducting at least one selective hydrogenation of diolefins and acetylenic compounds contained in the feedstock, (b) conducting at least one separation of effluent obtained at the en of step (a1) into at least three fractions: a light fraction containing olefins, and from which substantially all of the sulfur has been removed, a heavy fraction in which most of the sulfur compounds initially contained in the gasoline feedstock is concentrated, and at least one intermediate fraction, (c1) conducting at least one treatment of the heavy fraction separated at step (b) on a catalyst enabling the sulfur compounds to be at least partially decomposed or hydrogenated, and (d) conducting at least one step to remove sulfur and nitrogen from at least one intermediate fraction.

* * * * *

UNITED STATES PATENT AND TRADEMARK OFFICE

CERTIFICATE OF CORRECTION

PATENT NO. : 6,830,678 B2
DATED : December 14, 2004
INVENTOR(S) : Blaise Didillon et al.

It is certified that error appears in the above-identified patent and that said Letters Patent is hereby corrected as shown below:

Column 20,
Lines 62-63, reads “fraction” should read -- fractions --.

Column 21,
Line 47, reads “hydrogen n to” should read -- hydrogen to --.

Column 22,
Line 17, reads “hydrogen n to” should read -- hydrogen to --.
Line 24, reads “the en of step” should read -- the end of step --.

Column 23,
Line 3, reads “decompose” should read -- decomposed --.
Line 25, reads “hydrogenated” should read -- hydrogenated. --.
Lines 26-27, delete the lines.

Column 24,
Line 25, reads “the en of step” should read -- the end of step --.

Signed and Sealed this

Fourth Day of October, 2005

JON W. DUDAS
*Director of the United States Patent and Trademark Office*